US008668451B2

(12) United States Patent
Haynes

(10) Patent No.: US 8,668,451 B2
(45) Date of Patent: Mar. 11, 2014

(54) FAN BLADE MOUNTING SYSTEM

(75) Inventor: Fred Haynes, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 785 days.

(21) Appl. No.: 12/871,091

(22) Filed: Aug. 30, 2010

(65) Prior Publication Data

US 2011/0058947 A1 Mar. 10, 2011

Related U.S. Application Data

(60) Provisional application No. 61/241,188, filed on Sep. 10, 2009.

(51) Int. Cl.
*F04D 29/34* (2006.01)

(52) U.S. Cl.
USPC ..... 416/5; 416/206; 416/207; 416/210 R; 416/219 R; 416/220 A

(58) Field of Classification Search
USPC ..... 416/5, 204 R, 206, 207, 210 R, 219 R, 416/220 R, 220 A, 219 A
See application file for complete search history.

(56) References Cited

U.S. PATENT DOCUMENTS

| | | | | |
|---|---|---|---|---|
| 5,110,261 | A | 5/1992 | Junkin | |
| 5,304,037 | A | 4/1994 | Scofield | |
| 5,464,323 | A | 11/1995 | Scofield | |
| 5,927,945 | A * | 7/1999 | Chen | 416/5 |
| 5,944,487 | A | 8/1999 | Pearce | |
| 5,951,197 | A * | 9/1999 | Wu | 416/206 |
| 6,048,173 | A * | 4/2000 | Chen | 416/210 R |
| 6,062,820 | A * | 5/2000 | Wang | 416/210 R |
| 6,095,753 | A | 8/2000 | Hsu | |
| 6,139,276 | A * | 10/2000 | Blateri et al. | 416/210 R |
| 6,241,475 | B1 * | 6/2001 | Blateri et al. | 416/210 R |
| 6,347,924 | B1 * | 2/2002 | Chang | 416/210 R |
| 6,378,824 | B1 * | 4/2002 | Tseng | 416/210 R |
| 6,382,917 | B1 | 5/2002 | Zuege | |
| 6,390,777 | B1 * | 5/2002 | Kerr, Jr. | 416/204 R |
| 6,494,682 | B1 * | 12/2002 | Blateri et al. | 416/206 |
| 6,699,014 | B1 | 3/2004 | Lam et al. | |
| 6,857,854 | B2 | 2/2005 | Pearce | |
| 6,863,499 | B2 | 3/2005 | Pearce | |
| 6,902,375 | B2 | 6/2005 | Bird et al. | |
| 6,932,576 | B2 | 8/2005 | Bird | |
| 7,134,844 | B2 * | 11/2006 | Robin | 416/210 R |
| RE39,448 | E * | 12/2006 | Wu | 416/206 |
| 7,413,410 | B2 | 8/2008 | Shahin et al. | |
| 7,527,478 | B2 | 5/2009 | Pearce | |
| 7,665,970 | B2 | 2/2010 | Pearce | |
| 2008/0175710 | A1 | 7/2008 | Pearce | |
| 2008/0175713 | A1 | 7/2008 | Pearce | |

* cited by examiner

*Primary Examiner* — Igor Kershteyn
(74) *Attorney, Agent, or Firm* — Baker Donelson; Dorian B. Kennedy

(57) ABSTRACT

A ceiling fan (10) is disclosed which has a motor (13) and an annular array of blade irons (14) each having a blade (15) mounted thereto. Each blade iron includes a body portion (18) and a mounting portion (19). The body portion (18) has a motor mounting flange (21) which includes a trapezoidal shaped groove 28 and a flat spring (32). The mounting portion (19) includes a trapezoidal shaped or dove tailed tongue (40) which has a depression (42) adapted to receive the spring to lock to the position of the body portion relative to the mounting portion.

17 Claims, 5 Drawing Sheets

FAN BLADE MOUNTING SYSTEM

REFERENCE TO RELATED APPLICATION

Applicant claims the benefit of U.S. Provisional Patent Application Ser. No. 61/241,188 filed Sep. 10, 2009.

TECHNICAL FIELD

This invention relates to ceiling fan blade irons, and specifically to systems for quickly connecting blade irons to a motor.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the blade irons for compactness, and the blade irons packed separately from the motor. In mounting a ceiling fan, the housing is normally mounted in suspension from the ceiling through a downrod and then the blades are mounted to the blade irons and the blade irons are mounted to the motor.

The blade irons are typically coupled to the motor by passing mounting screws through holes in the blade iron and into threaded holes in the motor. This task however can be difficult or tedious when the electric motor is already suspended from the ceiling. The difficulty is attributed to the fact that the mounting screws are usually passed from the top of the blade iron to hide the screw heads from view. The installer must align the holes in the blade iron with the holes in the motor while simultaneously passing the screws through the holes. The installer typically does this from a position below the ceiling fan, thereby limiting the installer's ability to view the mounting holes and thus aligning the mounting holes and drivably rotate the screws.

Similarly, the blades of ceiling fans are usually coupled to the blade irons by passing mounting screws through holes in the blade and into threaded holes in the blade iron. Again, this task however can be difficult or tedious for the same reasons previously described in reference to mounting the blade irons to the motor.

Accordingly, it is seen that a need remains for a blade iron that can be quickly and easily mounted to a motor. It is to the provision of such therefore that the present invention is primarily directed.

SUMMARY OF THE INVENTION

A fan blade iron mounting system comprises fan having a motor, an annular array of blade iron coupled to the motor with a longitudinal axis extending generally along the length of the blade iron, and a blade coupled to each blade iron of the annular array of blade irons. Each said blade iron has a mounting portion coupled to the motor and a body portion removably coupled to the mounting portion. The mounting portion has a dove tailed tongue positioned along the longitudinal axis. The body portion has a mounting flange with a notch positioned along the longitudinal axis configured to receive the mounting portion dove tailed tongue.

DETAILED DESCRIPTION

Figure 1:
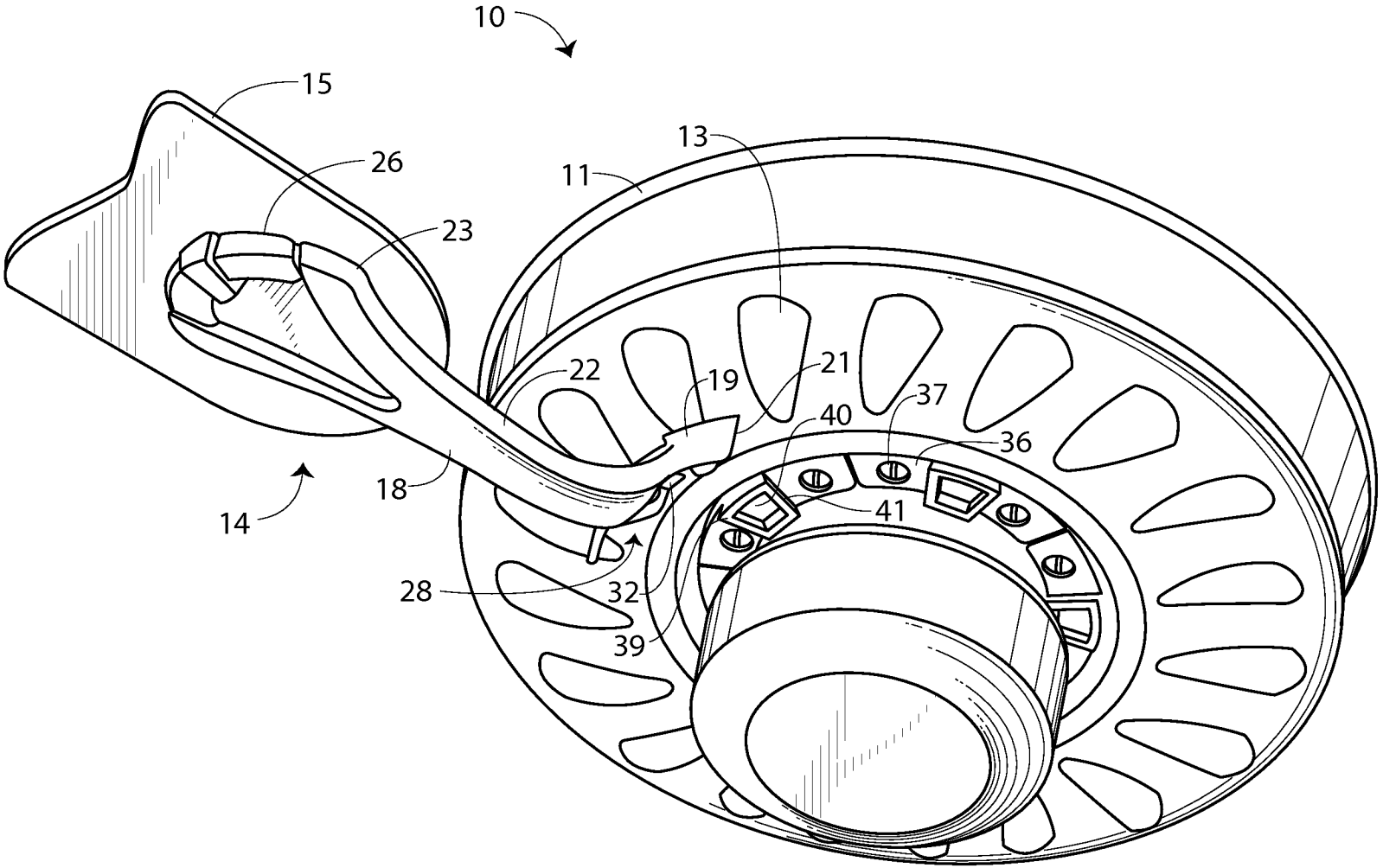
FIGS. 1-4 are a series of perspective views of the ceiling fan blade iron shown being mounted to a motor embodying principles of the invention in a preferred form.

With reference next to the drawings, there is shown a ceiling fan 10 having a motor housing 11 suspended from an unshown ceiling by an unshown downrod. An electric motor 13 is mounted within the housing 11 and connected to a source of electric power by wires that extend through the downrod. The motor 13 rotatably drives an annular array of blade irons 14 about a motor central axis of rotation AR, only one being shown for clarity, each having a blade 15 mounted thereto.

Each blade iron 14 is comprised of a body portion 18 and a mounting portion 19. The body portion 18 has a motor mounting flange 21 configured to be coupled with the electric motor 13 for rotation through the mounting portion 19, a neck 22, and a blade mounting portion 23. The blade mounting portion 23 has a top surface 26 facing the ceiling upon which the blade 15 is positioned. The motor mounting flange 21 includes a trapezoidal shaped or dove tailed notch or groove 28 defined by side walls 29 and an end wall 30. The sidewalls 29 are angled so that they diverge from each other as they extend in a horizontally outward or outboard direction from the motor or motor axis of rotation RA. The sidewalls are oriented so that they are generally 15 degrees from a central radial CR and approximately 45 degrees from vertical. The motor mounting flange 21 also includes a flat spring 32 mounted to the end wall 30 and secured thereto through a mounting screw 33.

The blade iron mounting portion 19 is coupled to the rotating portion of the electric motor 13, whether that be the stator or the rotor. The mounting portion 19 includes a base 35 with two oppositely disposed mounting holes 36 through which mounting screws 37 are passed and threaded into mounting holes within the motor. The mounting portion 19 also includes a trapezoidal shaped or dove tail or dove tailed tongue or portioned 40 extending from the base 35. The dove tailed tongue 40 includes a spring receiving depression or well 42 adapted to receive spring 32 and oppositely disposed side walls 41. The side walls 41 diverge as they extend horizontally, radially or outwardly, each side wall diverging approximately 15 degrees from a central radii CR so that they conform with the notch side walls 29. The side walls 41 also diverge from each other as they extend vertically from the base 35, each side walls diverging approximately 45 degrees from vertical so that they again conform with the notch side walls 29. The term vertical as used herein is intended to designate general vertical or up and down direction, and is not invented to reflect a perfectly vertical direction.

Figure 2:
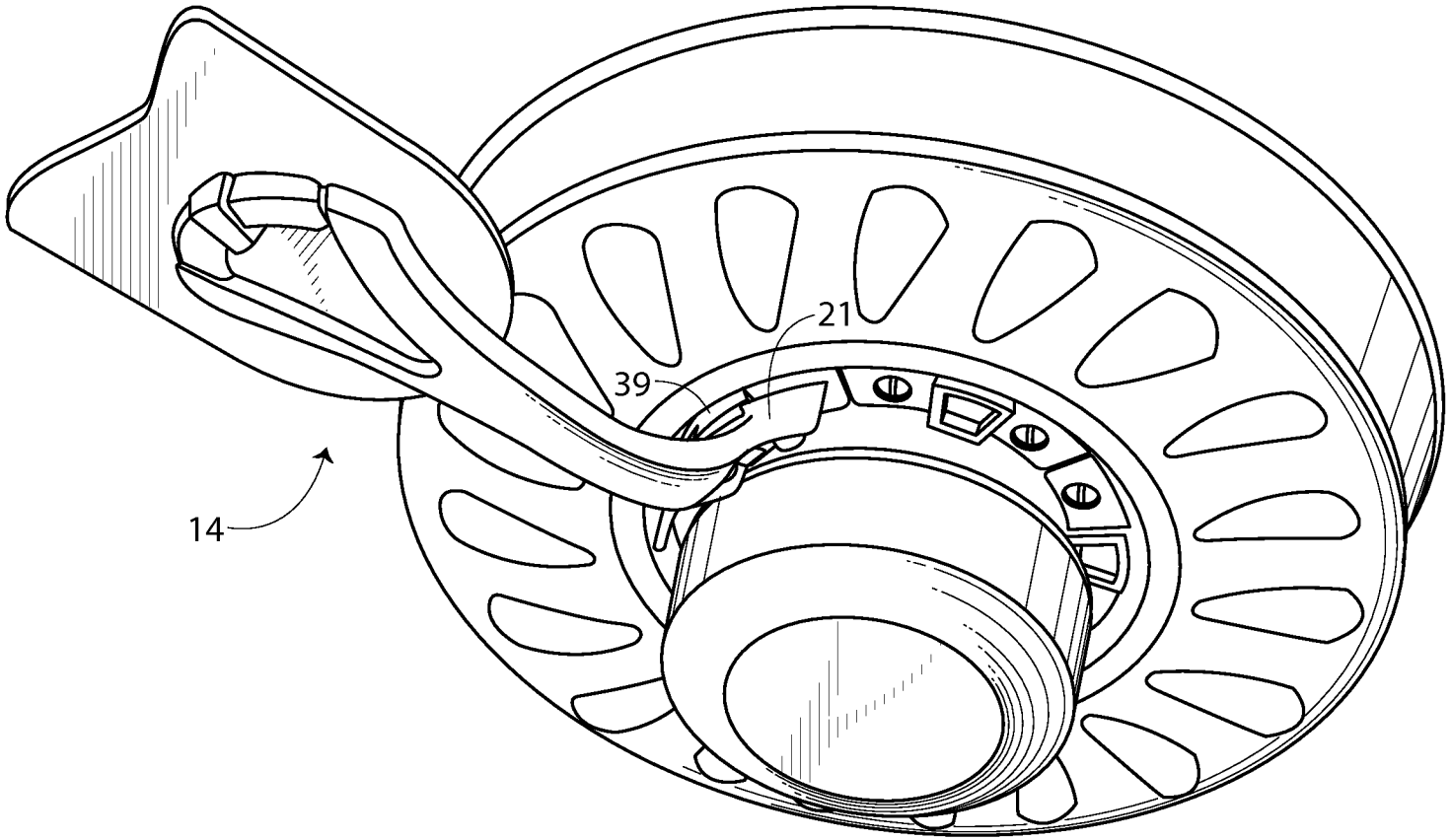
Figure 3:
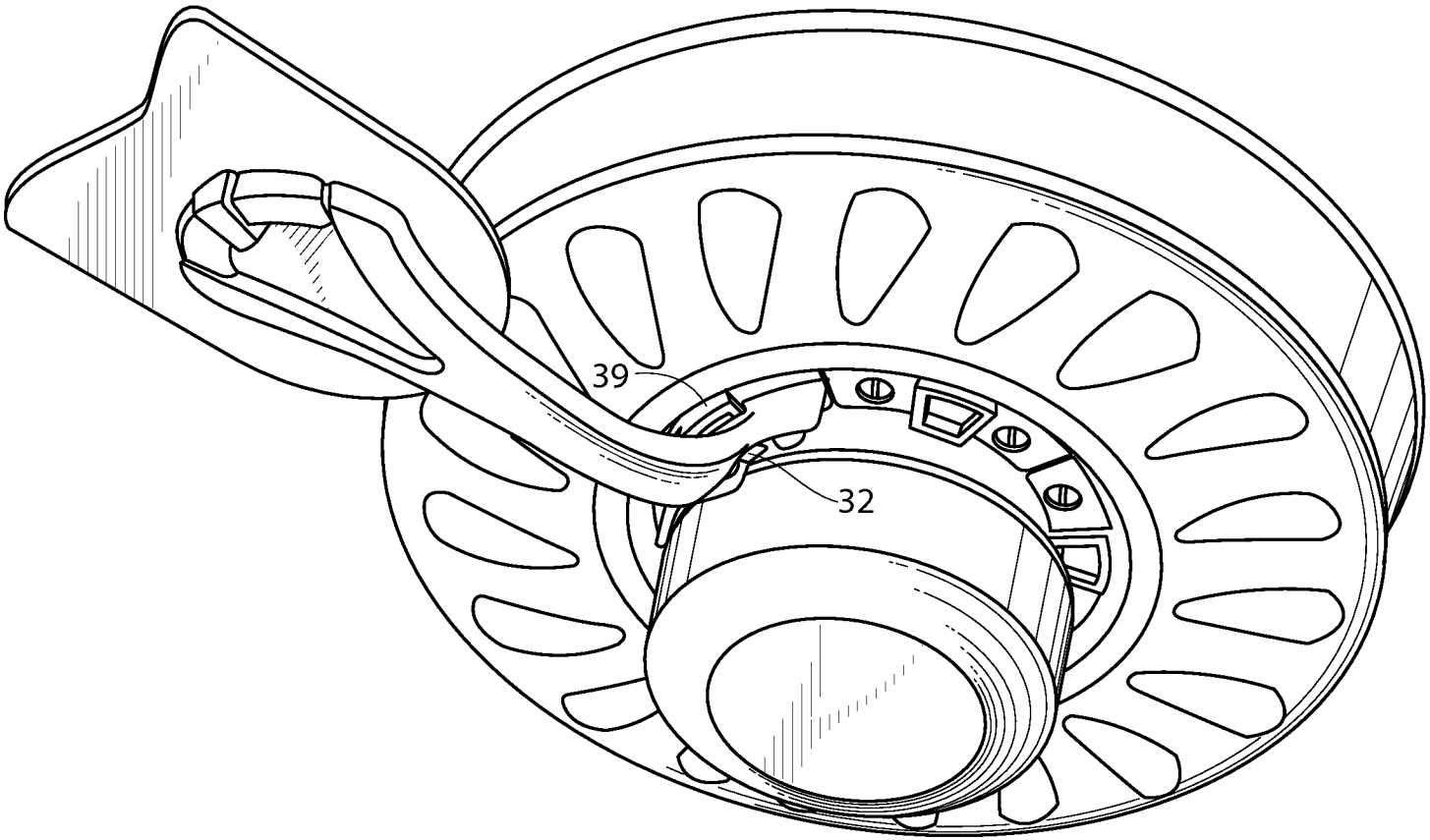
Figure 4:
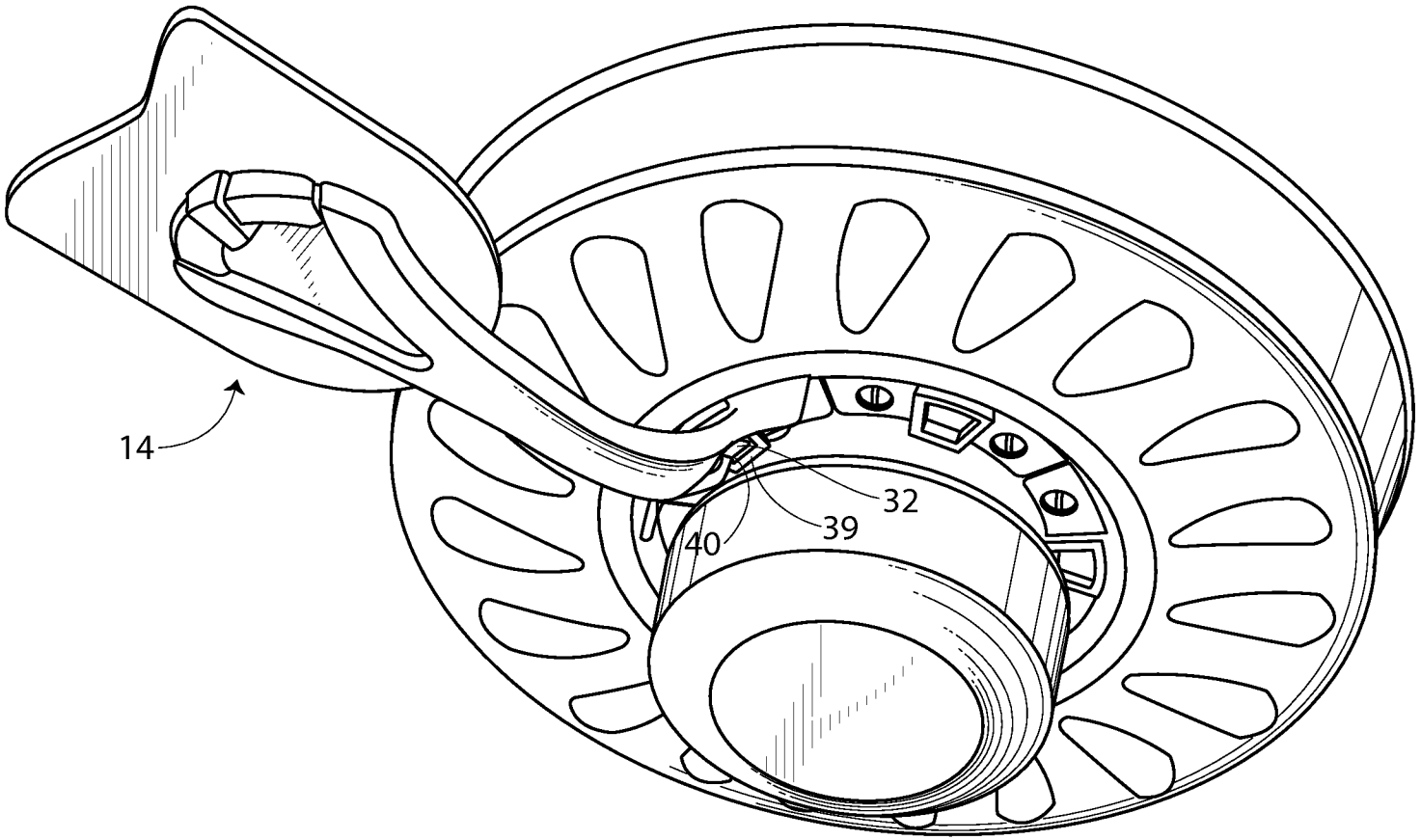
Figure 5:
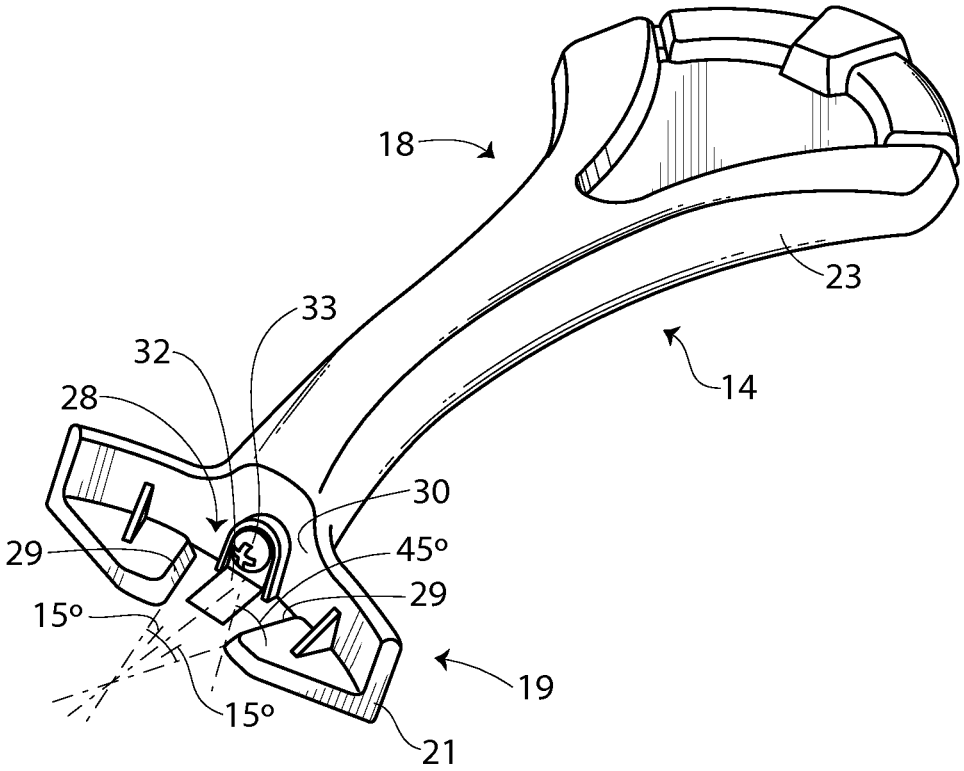
FIG. 5 is an enlarged perspective view of a portion of the fan blade iron of FIG. 1, shown in an inverted position.
Figure 6:
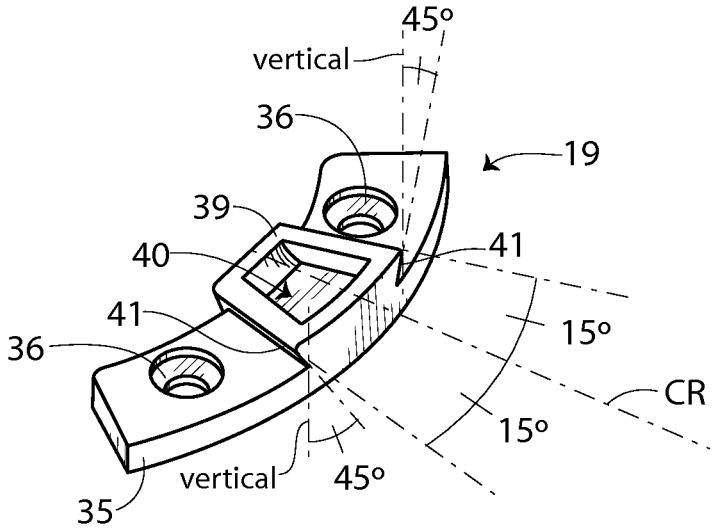
FIG. 6 is an enlarged perspective view of a portion of the fan blade iron of FIG. 1, shown in an inverted position.

In use, the ceiling fan motor 13 and motor housing 11 are coupled to the ceiling in conventional fashion, with the blade iron mounting portion 19 previously mounted to the motor 13 as shown in FIG. 1. The blades 15 are then mounted to the blade irons body portion 18 in any conventional fashion. Lastly, the blade iron body portions 18 are coupled to the blade iron mounting portions 19. The mounting is accomplished by passing the blade iron mounting flange 21 past the mounting portion 19, as shown in FIG. 2, to a position wherein the dove shaped notch 28 is aligned with the dove tailed tongue 40, as shown in FIG. 3. The blade iron 14 is then moved axially outboard or outwardly to a position wherein the positioning the dove shaped tongue 40 is nested firmly within the dove shaped notch 28. The final outboard movement causes the flat spring 32 to move into depression 42 and be biased within the depression 42 and against the inboard wall of the depression, as shown in FIG. 4.

With the blade iron body portion 18 coupled to the mounting portion 19, the rotation of the motor creates a centrifugal force upon the body portion 18 which acts to force the body portion outwardly, thereby further tightening the fit between the dove tailed notch 28 and dove tailed tongue 40 because to the diverging side walls of each. The position of the spring 32 within depression 42 prevents the inward or inboard movement of the blade iron body portion, thereby preventing the unwanted uncoupling of the body portion from the mounting portion.

To remove the blade iron, the spring 32 is manually biased from the depression and the blade iron body portion 18 is moved inwardly or inboard so as to be disengaged from the mounting portion 19.

It should be understood that other types of retaining means may be utilized as a substitute for the flat spring 32, such as a detent, pawl, or other similar device.

It thus is seen that a quick connect ceiling fan blade iron is now provided which enables the blade iron to be mounted and dismounted easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A fan comprising, a motor;

an annular array of blade iron coupled to said motor with a longitudinal axis extending generally along the length of said blade iron;

a blade coupled to each said blade iron of said annular array of blade irons;

each said blade iron having a mounting portion coupled to said motor and a body portion removably coupled to said mounting portion, said mounting portion having a dove tailed tongue positioned along said longitudinal axis, said body portion having a mounting flange with a notch positioned along said longitudinal axis configured to receive said mounting portion dove tailed tongue.

2. The fan of claim 1 wherein said dove tailed tongue has side walls which diverge from each other as they extend in a generally horizontally outward direction.

3. The fan of claim 1 wherein said dove tailed tongue has side walls that diverge from each other as they extend in a generally vertically downward direction.

4. The fan of claim 3 wherein said dove tailed tongue has side walls which diverge from each other as they extend in a generally horizontally outward direction.

5. The fan of claim 1 wherein said blade iron has locking means for locking the position of said blade iron body portion to said blade iron mounting portion.

6. The fan of claim 1 wherein said dove tailed tongue has a recess and wherein said body portion mounting flange has a spring configured to be biased into said recess, whereby the spring locks the position of the blade iron body portion relative to said blade iron mounting portion.

7. The fan of claim 6 wherein said recess has an inboard side wall and wherein said spring is a flat spring configured to abut said inboard side wall when said blade iron body portion is in a locked position with said blade iron mounting portion.

8. A blade iron for a fan having an electric motor, said blade iron comprising, a mounting portion coupled to the motor and having a trapezoidal shaped tongue;

a body portion removably coupled to said mounting portion and having a mounting flange with a notch configured to receive said mounting portion trapezoidal shaped tongue, wherein said trapezoidal shaped tongue has side walls which diverge from each other as they extend in a generally horizontally outward direction.

9. A blade iron for a fan having an electric motor, said blade iron comprising, a mounting portion coupled to the motor and having a trapezoidal shaped tongue;

a body portion removably coupled to said mounting portion and having a mounting flange with a notch configured to receive said mounting portion trapezoidal shaped tongue, wherein said trapezoidal shaped tongue has side walls that diverge from each other as they extend in a generally vertically downward direction.

10. The blade iron of claim 9 wherein said trapezoidal shaped tongue has side walls which diverge from each other as they extend in a generally horizontally outward direction.

11. A blade iron for a fan having an electric motor, said blade iron comprising, a mounting portion coupled to the motor and having a trapezoidal shaped tongue;

a body portion removably coupled to said mounting portion and having a mounting flange with a notch configured to receive said mounting portion trapezoidal shaped tongue, wherein said trapezoidal shaped tongue has a recess and wherein said body portion mounting flange has a spring configured to be biased into said recess, whereby the spring locks the position of the blade iron body portion relative to said blade iron mounting portion.

12. The blade iron of claim 11 wherein said recess has an inboard side wall and wherein said spring is a flat spring configured to abut said inboard side wall when said blade iron body portion is in a locked position with said blade iron mounting portion.

13. A fan comprising, a motor having a central axis of rotation;

an annular array of blade iron coupled to said motor;

a blade coupled to each said blade iron of said annular array of blade irons;

each said blade iron having a mounting portion coupled to said motor and a body portion removably coupled to said mounting portion, said blade iron mounting portion having a base and a tongue extending from said base, said tongue having two oppositely disposed side walls which diverge from each other as they extend generally normal to and outwardly from said motor axis of rotation;

said blade iron body portion having a mounting flange with a notch configured to receive said mounting portion tongue, said mounting flange notch having two oppositely disposed side walls which diverge from each other as they extend generally normal to and outwardly from said motor axis of rotation so as to conform with said blade iron mounting portion tongue oppositely disposed side walls.

14. The fan of claim 13 wherein each said blade iron mounting portion tongue side walls also diverge from each other as they extend away from said mounting portion base.

15. The fan of claim 13 wherein said blade iron has locking means for locking the position of said blade iron body portion to said blade iron mounting portion.

16. The fan of claim 13 wherein said mounting portion tongue has a recess and wherein said body portion mounting flange has a spring configured to be biased into said recess, whereby the spring locks the position of the blade iron body portion relative to said blade iron mounting portion.

17. The fan of claim 16 wherein said recess has an inboard side wall and wherein said spring is a flat spring configured to abut said inboard side wall when said blade iron body portion is in a locked position with said blade iron mounting portion.

* * * * *